US010060383B2

(12) United States Patent
Quiring et al.

(10) Patent No.: US 10,060,383 B2
(45) Date of Patent: Aug. 28, 2018

(54) RECIPROCATING PISTON ENGINE WITH LINER

(71) Applicant: Ford Global Technologies, LLC, Dearborn, MI (US)

(72) Inventors: Stefan Quiring, Leverkusen (DE); Klaus-Peter Heinig, Aachen (DE); Bernd Steiner, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 139 days.

(21) Appl. No.: 15/012,450

(22) Filed: Feb. 1, 2016

(65) Prior Publication Data

US 2016/0230695 A1 Aug. 11, 2016

(30) Foreign Application Priority Data

Feb. 5, 2015 (DE) ..... 10 2015 201 994

(51) Int. Cl.
*F02F 1/10* (2006.01)
*F02F 1/00* (2006.01)

(52) U.S. Cl.
CPC ..... *F02F 1/004* (2013.01); *F02F 1/10* (2013.01); *F02F 2001/104* (2013.01); *F05C 2251/02* (2013.01)

(58) Field of Classification Search
CPC .... F16J 10/04; F02F 1/004; F02F 1/16; F05C 2201/021; F05C 2201/0436; F05C 2201/0439; F05C 2201/0448; F05C 2251/042
USPC ..... 123/41.83, 193.2, 193.1, 193.3, 193.5; 29/888.01, 888.06, 888.061
See application file for complete search history.

(56) References Cited

U.S. PATENT DOCUMENTS 2,320,830 A * 6/1943 Ricardo ..... F02B 77/02 123/314
2,327,694 A * 8/1943 Barraja-Frauenfelder et al. ..... F02F 1/186 123/41.78
2,383,285 A * 8/1945 Bayles ..... F02F 1/186 123/193.1

(Continued)

FOREIGN PATENT DOCUMENTS

DE 2532133 A1 * 2/1977 ..... F02F 1/16
DE 3829854 A1 * 3/1990 ..... F02F 1/16

(Continued)

OTHER PUBLICATIONS

DE 19841102 English Translation.*

*Primary Examiner* — Marguerite McMahon
*Assistant Examiner* — Tea Holbrook
(74) *Attorney, Agent, or Firm* — Julia Voutyras; McCoy Russell LLP

(57) ABSTRACT

A reciprocating piston engine which has a cylinder block, at least one combustion chamber arranged in the cylinder block and a liner which borders the combustion chamber and is composed of a first material is provided. In one example, the reciprocating piston engine comprises a reinforcing element composed of a second material for the radial reinforcement of the liner, said reinforcing element being arranged between the cylinder block and the liner and at least partially surrounding the liner, with the second material having a higher modulus of elasticity than the first material.

16 Claims, 5 Drawing Sheets

(56) References Cited

U.S. PATENT DOCUMENTS 3,073,290 A * 1/1963 Stump ..... F02F 1/08 123/41.69
3,389,693 A * 6/1968 Herschmann ..... F02F 1/16 123/41.84
4,466,399 A * 8/1984 Hinz ..... F02B 23/0675 123/193.1
4,616,603 A * 10/1986 Kubis ..... F02B 75/16 123/193.2
4,791,891 A * 12/1988 Kubis ..... F02F 11/002 123/193.2
4,856,462 A * 8/1989 Ushio ..... F02F 1/108 123/193.2
5,005,469 A * 4/1991 Ohta ..... B22D 19/0009 123/41.84
5,086,733 A * 2/1992 Inoue ..... F01P 3/02 123/41.79
5,251,579 A * 10/1993 Morris ..... F02F 1/163 123/195 R
5,357,921 A * 10/1994 Katoh ..... B22D 19/0009 123/193.2
5,450,827 A * 9/1995 Kang ..... F02F 1/102 123/193.2
5,732,671 A * 3/1998 Takami ..... B22D 19/0009 123/193.2
5,873,163 A * 2/1999 Diefenthaler ..... B23P 6/02 29/888.011
5,961,127 A * 10/1999 Onda ..... F02B 75/16 277/598
7,255,069 B2 * 8/2007 Liebert ..... F02F 1/102 123/193.5
7,472,673 B2 * 1/2009 Liebert ..... F02F 1/102 123/193.2
7,726,273 B2 6/2010 Azevedo et al.
8,468,694 B2 * 6/2013 Moss ..... F02F 1/004 29/888.011
2003/0116114 A1 * 6/2003 Rengmyr ..... B22D 17/24 123/195 R
2004/0086701 A1 * 5/2004 Brinkschroeder ..... B22D 19/14 428/293.1
2004/0231630 A1 * 11/2004 Liebert ..... F02F 1/102 123/193.3
2005/0247428 A1 * 11/2005 Cantu-Gonzalez ..... B22C 1/14 164/138
2006/0213465 A1 * 9/2006 Sunada ..... B23K 20/129 123/41.84
2006/0249116 A1 * 11/2006 Liebert ..... F02F 1/102 123/193.2
2007/0209627 A1 * 9/2007 Bing ..... B22D 19/0009 123/193.2
2011/0016711 A1 * 1/2011 Simpson ..... F02F 1/004 29/888.061
2011/0168109 A1 * 7/2011 Roth ..... F16J 10/04 123/41.84

FOREIGN PATENT DOCUMENTS

DE 19841102 C1 * 3/2000 ..... F02F 1/16
DE 102011102203 A1 11/2012
EP 0491978 B1 9/1994
JP 60094230 A * 5/1985 ..... B23P 15/00
JP S61180633 A 8/1986
JP 04041961 A * 2/1992
KR 1020060058241 A 5/2006
RU 2076226 C1 3/1997
WO 2008059330 A1 5/2008
WO 2014006199 A2 1/2014
WO WO 2014006199 A2 * 1/2014 ..... B22D 19/0009
WO 2014006199 A3 4/2014

* cited by examiner

RECIPROCATING PISTON ENGINE WITH LINER

CROSS REFERENCE TO RELATED APPLICATION

The present application claims priority to German Patent Application No. 102015201994.2, filed on Feb. 5, 2015, the entire contents of which are hereby incorporated by reference for all purposes.

FIELD

The present description relates generally to a reciprocating piston engine for a motor vehicle.

BACKGROUND/SUMMARY

Reciprocating piston engines in which a cylinder bore in a cylinder block is line with a liner are known in the field. For example, WO 2014/006199 A2 discloses a cylinder liner composed of gray cast iron for casting into an engine block of an internal combustion engine, in which a means for reinforcing the connection of the cylinder liner to the casting material of the engine block is arranged at least in regions on an outer circumferential surface of the cylinder liner, the means being a wire mesh or wire grating that does not melt or open while the engine block is cast, wherein the means is welded to the cylinder liner in at least one region.

The present disclosure provides an improved reciprocating piston engine and a motor vehicle with such a reciprocating engine. One example includes a reciprocating piston engine which has a cylinder block, at least one combustion chamber arranged in the cylinder block, and a liner which borders the combustion chamber and is composed of a first material, wherein the reciprocating piston engine comprises a reinforcing element composed of a second material for the radial reinforcement of the liner, said reinforcing element being arranged between the cylinder block and the liner and at least partially surrounding the liner, with the second material having a higher modulus of elasticity than the first material.

According to the present disclosure, an arrangement which imparts greater rigidity to the at least one liner is provided. The liner may then therefore, be better protected against bore distortion which may arise at the upper end of the liner during operation of the reciprocating piston engine because of combustion pressures and high temperatures, in particular in the case of open deck designs. A smaller bore distortion may permit the use of piston rings having a lower pretension, and therefore, the friction between the piston ring and the liner may be reduced. Greater efficiency of the reciprocating piston engine may therefore be achieved. An increased efficiency may further lead to preserving fuel and may reduce $CO_2$ emission by the engine.

Other attempts to address negative impacts on bore distortion due to higher movement distances of the liners in an "open deck" reciprocating engine include the incorporation a metal matrix composite (MMC) closely fitted onto the outer periphery of the cylinder liner. One example approach is shown by Takami et al. in WO 2008/059330. Therein, an open-deck cylinder block with a cylinder liner incorporating a metal matrix composite ring is closely fitted onto an outer periphery of the cylinder liner and the MMC ring faces the top deck. Further, the liner material has a higher strength relative to that of the cylinder block material.

However, the inventors herein have recognized potential issues with such systems. As one example, MMC materials are typically higher cost relative to other common materials such as steel and MMC materials may further require complex fabrication methods for fiber-reinforced systems. As a further example, for degassing and manufacturing reasons, many cylinder blocks of internal combustion engines have an open deck design. The term "open deck" as used herein refers to an engine in which the top of the cylinder liners is not directly connected to the outer walls of the cylinder block. The open deck designs however may have a negative impact on bore distortion however because of the higher movement distances of the liners. For low friction between liner and piston, a low bore distortion may be required. For this reason, the high bore distortion may have a substantial impact on fuel economy. This may become more and more significant for high loaded turbocharged engines.

In one example, the issues described above may be addressed by a reciprocating piston engine which has a cylinder block, at least one combustion chamber arranged in the cylinder block, and a liner which borders the combustion chamber and is composed of a first material, wherein the reciprocating piston engine comprises a reinforcing element composed of a second material for the radial reinforcement of the liner, said reinforcing element being arranged between the cylinder block and the liner and at least partially surrounding the liner, with the second material having a higher modulus of elasticity than the first material. In this way, the degassing benefits of the open deck cylinder block may be combined with the structural rigidity and stiffness of the liners disposed between the cylinder and the engine block.

As one example of the disclosed reciprocating piston engine, the liner described may be composed of gray cast iron or aluminum and the reinforcing element may be composed of steel. It will be appreciated that as used herein, aluminum may refer also to aluminum alloys. Steel has a higher coefficient of elasticity when compared to gray cast iron or aluminum, and therefore, steel has a relatively high material rigidity. The liner in this case may be composed of the customary materials which have proven successful in regard to installation and operating properties.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-4 are shown approximately to scale, although other relative dimensions may be used.

DETAILED DESCRIPTION

The following description relates to a reciprocating piston engine for a motor vehicle which has a cylinder block, at least one combustion chamber arranged in the cylinder block, and a liner which borders the combustion chamber and is composed of a first material.

In one embodiment of the reciprocating piston engine according to the present disclosure, the liner may be composed of gray cast iron or aluminum and the reinforcing element may be composed of steel. Since steel has a higher coefficient of elasticity when compared to gray cast iron or aluminum, steel therefore has a high material rigidity relative to aluminum or gray cast iron.

Figure 1:
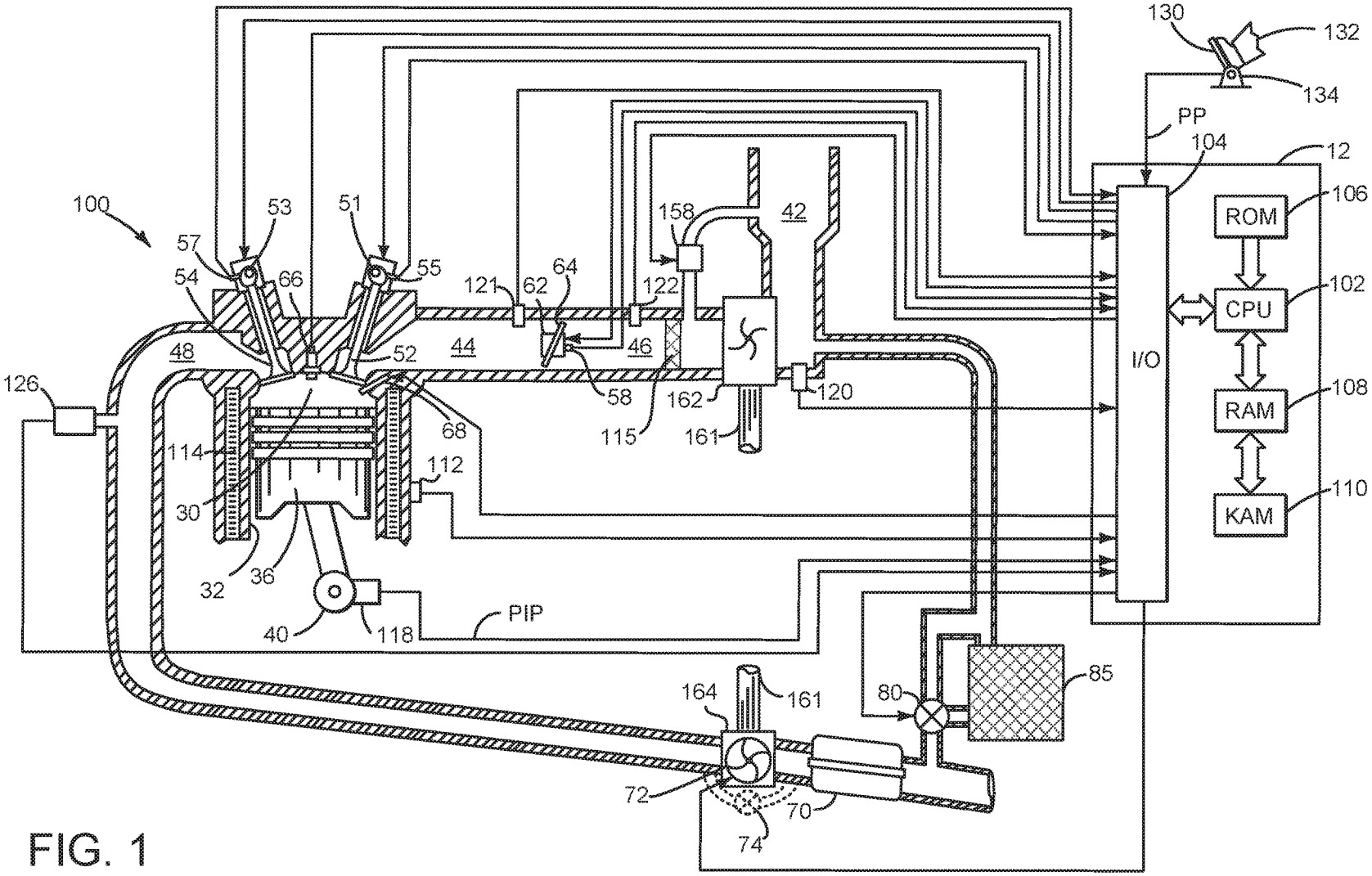
FIG. 1 shows a schematic depiction of an engine.
Figure 2:
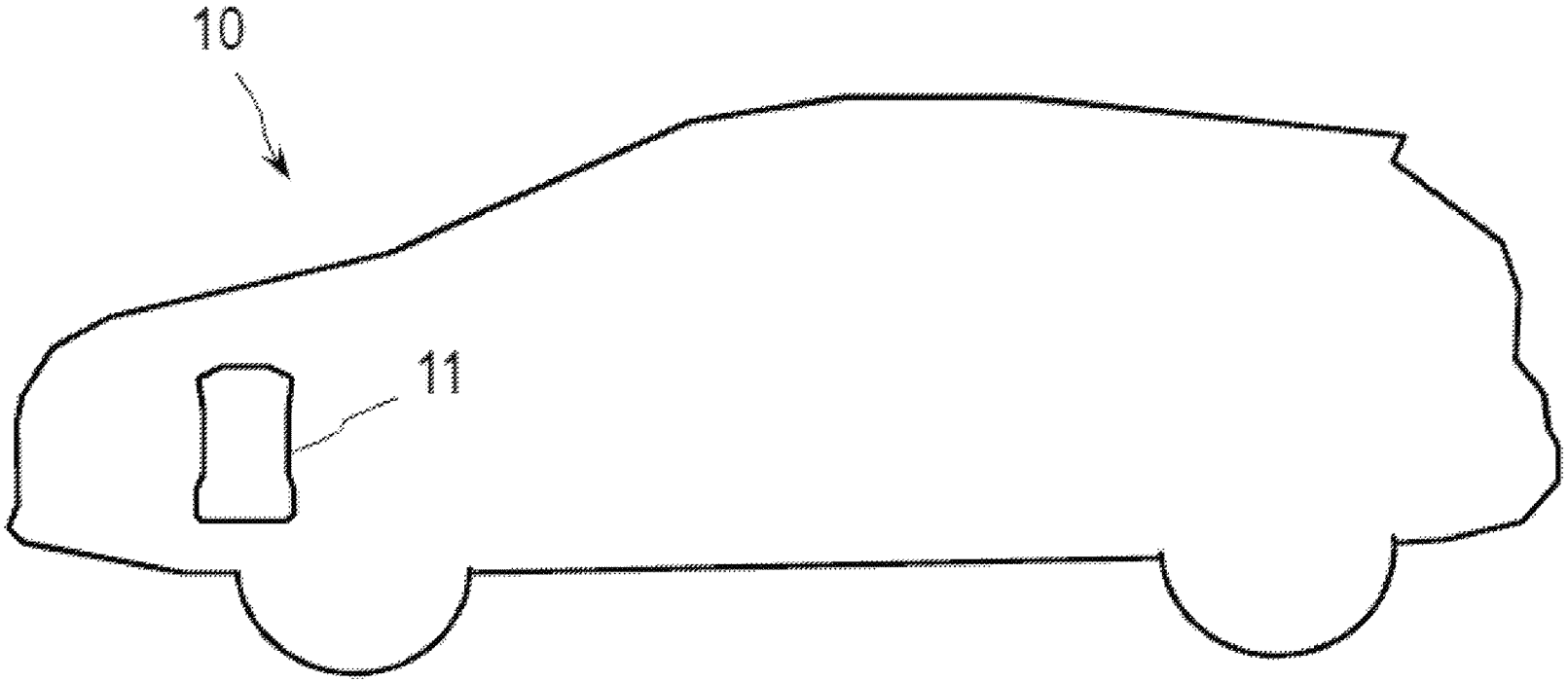
FIG. 2 shows an exemplary embodiment of a motor vehicle according to the disclosure.
Figure 3:
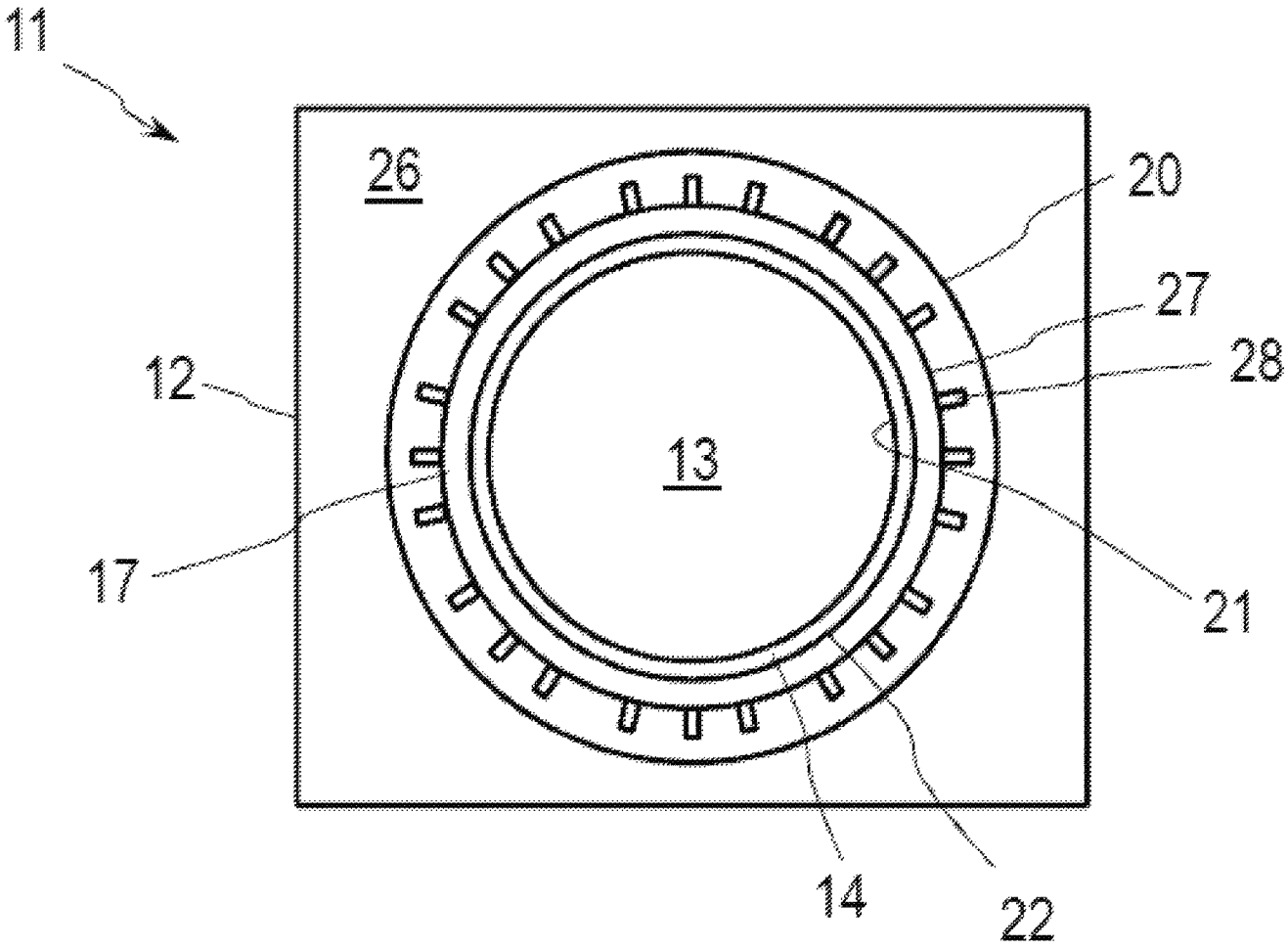
FIG. 3 shows a top view of a first exemplary embodiment of a reciprocating piston engine according to the disclosure.
Figure 4:
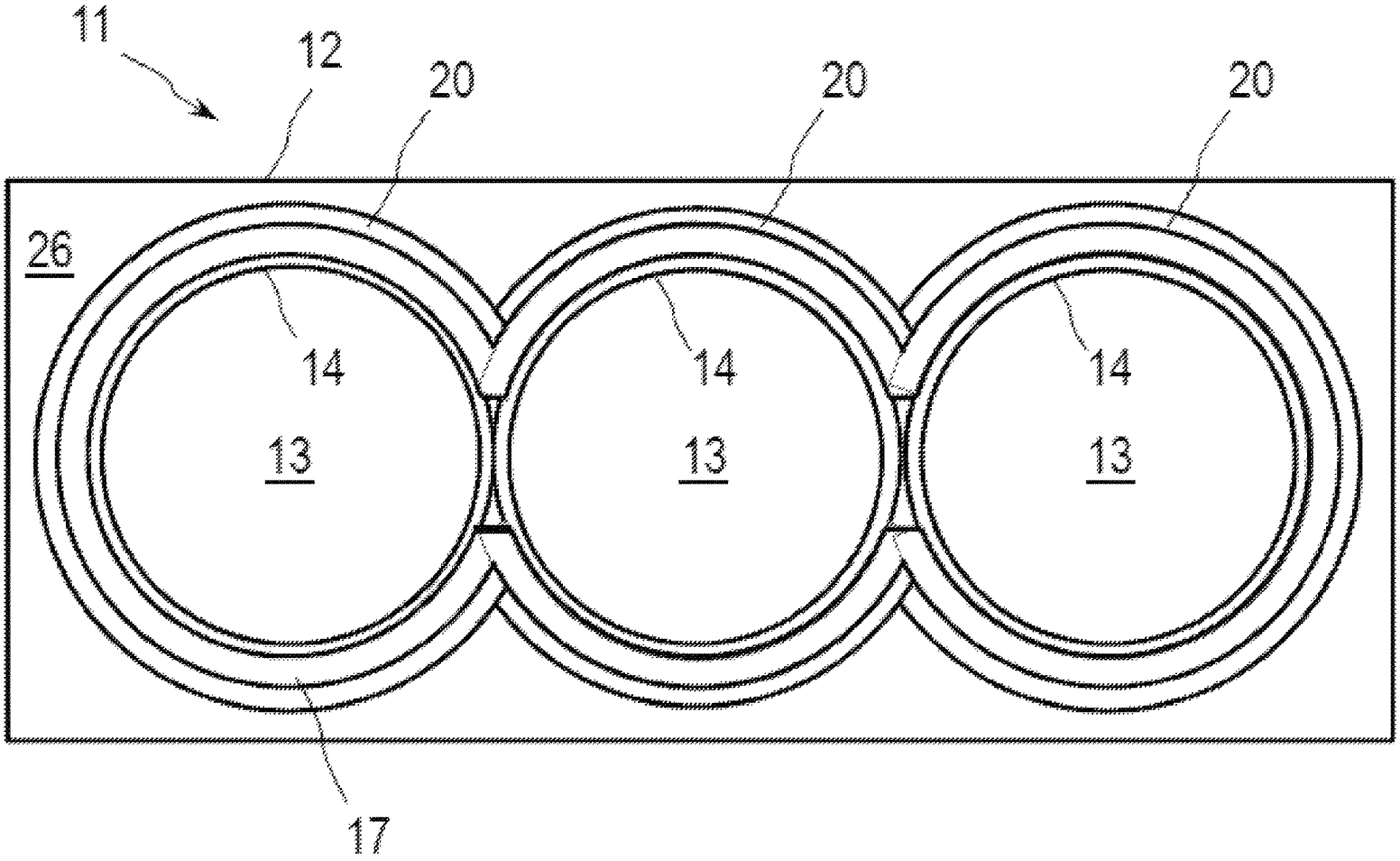
FIG. 4 shows a top view of a second exemplary embodiment of the reciprocating piston engine according to the disclosure.
Figure 5:
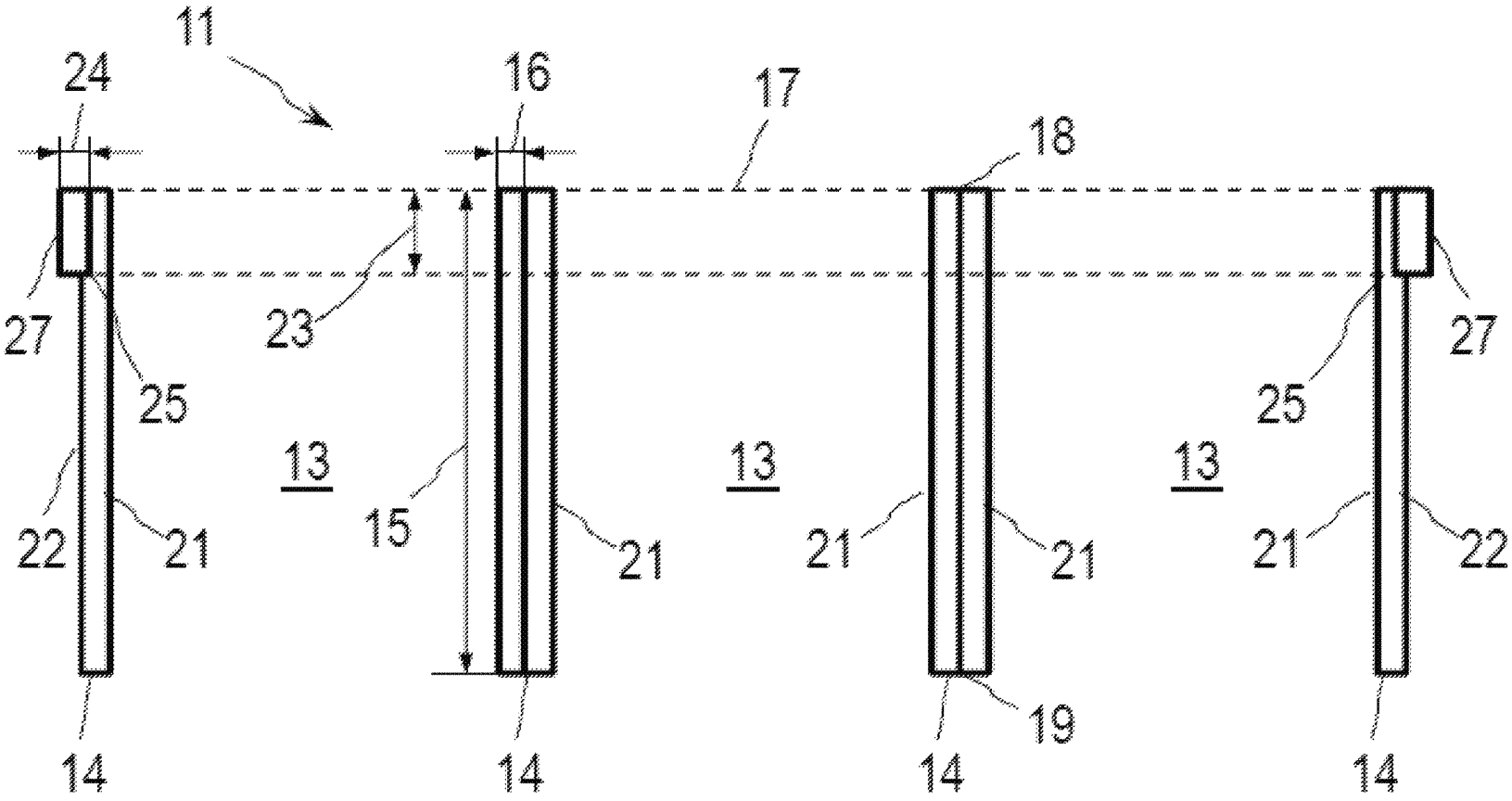
FIG. 5 shows a side view of the second embodiment of the reciprocating piston engine.

The figures provided herein show example representations of the reciprocating piston engine and liner system disclosed. FIG. 1 illustrates an example engine embodiment that may comprise the disclosed liner and reciprocating piston arrangement. In this illustration, the engine is shown comprising a turbine and compressor which may further increase the usefulness of the cylinder liner. For example, since compressors may be used within engines to compress and ultimately drive more air into the combustion chambers, the chambers and the cylinders may experience increased pressures and other stresses that may deteriorate or compromise the material of the cylinder block. FIG. 2 provides an example vehicle which may comprise the engine system described in FIG. 1 and which may further include the liner system and reinforcement element illustrated in subsequent figures. FIG. 3 shows a top-down view of a single cylinder comprising a liner, molding, and coolant duct arrangement. In this figure, the structural arrangement of the components and their relation to one another is shown. In FIG. 4, a further example embodiment is provided and is shown with 3 cylinders and combustion chambers. In this figure, the position of the liner and reinforcing element in an engine comprising more than one cylinder can be seen. FIG. 5 expands upon the embodiment presented in FIG. 4 and illustrates a side cross-sectional view of a cylinder block including 3 cylinders. Here, the position of the liner relative to the reinforcing element is shown.

With respect to FIG. 1, an example internal combustion engine 100 is illustrated. The internal combustion engine 100 of FIG. 1 may be controlled via an electronic engine controller 12 and may further include at least one combustion chamber 30. Combustion chamber 30 is shown in this figure communicating with an intake manifold 44 and an exhaust manifold 48 via respective intake valves 52 and exhaust valves 54. Each intake and exhaust valve may be operated by an intake cam 51 and an exhaust cam 53, respectively. The position of intake cam 51 may be determined by an intake cam sensor 55. Further, the position of the exhaust cam 53 may be determined by an exhaust cam sensor 57.

A fuel injector 66 is shown positioned such that it may inject fuel directly into combustion chamber 30, which is known to those skilled in the art as direct injection. Fuel injector 66 may deliver fuel in proportion to a pulse width from the controller unit 12. Fuel may be delivered to fuel injector 66 by a fuel system (not shown) including a fuel tank, a fuel pump, and fuel rail (not shown). Fuel pressure delivered to the combustion chamber 30 by the fuel system may be adjusted by varying a position valve and regulating the flow to a fuel pump. In addition, a metering valve may be located in or near the fuel rail for a closed loop fuel control. A pump metering valve may further regulate fuel flow to the fuel pump, thereby reducing fuel pumped to a high pressure fuel pump.

An intake manifold 44 is illustrated in FIG. 1 communicating with an optional electronic throttle 62 which may adjust the position of a throttle plate 64 in order to control air flow from an intake boost chamber 46. In one embodiment, the engine system 100 of the disclosure may include a turbine 164 and a compressor 162. The compressor 162 may draw air from the air intake 42 to supply the boost chamber 46. Exhaust gases may spin the turbine 164 which is coupled to compressor 162 via a shaft 161. A charge air cooler 115 may also be provided in at least one embodiment and the charge air cooler 115 may cool air compressed by the compressor 162. Compressor speed may be adjusted via adjusting a position of variable vane control 72 or compressor bypass valve 158. In alternative examples, a waste gate 74 may be used in addition to a variable vane control 72. The variable vane control 72 may adjust a position of variable geometry turbine vanes. Exhaust gases may pass through the turbine 164 and impart an increased force on turbine 164 when vanes are in a closed position. Compressor bypass valve 158 may allow compressed air at the outlet of compressor 162 to be returned to the input of compressor 162. In this way, the efficiency of compressor 162 may be reduced so as to affect the flow of compressor 162 and reduce intake manifold pressure.

Combustion within the engine system 100 provided may be initiated in combustion chamber 30 when fuel ignites via compression ignition as a piston 36 approaches to-dead-center compression stroke. In some examples, a universal exhaust gas oxygen (UEGO) sensor 126 may be coupled to exhaust manifold 48 upstream of an emissions device 70. In other examples, the UEGO sensor may be located downstream of one or more exhaust after treatment devices. Further, in some examples, the UEGO sensor may be replaced by a NOx sensor which may be inclusive of both NOx and Oxygen sensing elements.

At lower engine temperatures, a glow plug 68 may convert electrical energy into thermal energy so as to raise a temperature in the combustion chamber 30. By raising the temperature of the combustion chamber 30, it may be easier to ignite a cylinder air-fuel mixture via compression. Controller 12 may then adjust an amount of electrical power supplied to glow plug 68. Glow plug 68 may protrude into the cylinder and it may further include a pressure sensor integrated with the glow plug for determining pressure within the combustion chamber 30.

An emission control device 70 may be provided in at least one example embodiment and may be inclusive of a particulate filter and catalyst bricks. In another example embodiment, multiple emission control devices, each comprising multiple bricks, may be used. Further, emission control device 70 may include an oxidation catalyst in one example. In other examples, the emission control device may include a lean NOx trap or a selective catalyst reduction (SCR), and/or a diesel particulate filter (DPF). The emission device 70 of engine system 100 may be placed downstream in the engine's exhaust system relative to a turbine 164 such that the exhaust gas supplied to the turbine 164 may be converted to a safe form in order to release the exhaust into the atmosphere.

In another example, exhaust gas recirculation (EGR) may be provided in the engine via an EGR valve 80. EGR valve 80 may be a three-way valve that closes or opens to block or allow exhaust gas to flow from downstream of the emissions device 70 to a location in the engine air intake system upstream of a compressor 162. In alternative examples, EFT may flow from upstream of the turbine 164 to intake manifold 44. EGR may bypass EGR cooler 85 in one example, or alternatively, EGR may be cooled via passing through EGR cooler 85. In other examples, high pressure and low pressure EGR systems may be provided.

The controller 12 as provided in FIG. 1 is shown as a conventional microcomputer including: a microprocessor unit 102, input and output ports 104, read-only memory 106, random access memory 108, keep alive memory 110, and a conventional data bus. Controller 12 is shown receiving various signals from sensors coupled to engine 100, in addition to those signals previously discussed, including: engine coolant temperature (ECT) from temperature sensor 112 coupled to a cooling sleeve 114; a position sensor 134 coupled to an accelerator pedal 130 for sensing accelerator position as adjusted by a driver 132; a measurement of engine manifold pressure (MAP) from pressure sensor 121 coupled to intake manifold 44; boost pressure from pressure sensor 122; exhaust gas oxygen concentration from oxygen sensor 126; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed though a sensor is not shown in FIG. 1 for processing by controller 12. In one example embodiment of the present disclosure, an engine position sensor 118 may produce a predetermined number of equally spaced pulses for every revolution of the crankshaft from which engine speed (RPM) may be determined. The controller 12 of the engine system 100 may further act to control and subsequently actuate the valves described above.

It will be appreciated that in the engine embodiment provided in FIG. 1, the liner and reinforcing element described in further detail below may provide an increased resistance to additional forces and stresses imparted onto the cylinder block due to the turbocharger system displayed. Further, the reinforcing element and liner system may enhance the lifetime of the engine due to increasing the overall strength of the combustion chamber. In this way, a liner and reinforcement element may be used in engines other than the one shown in FIG. 1 such as diesel engines for example, and other engines which may benefit from increased structural rigidity and/or strength of the combustion chambers.

Turning now to FIG. 2, this figure illustrates an exemplary embodiment of a motor vehicle 10 according to the present disclosure. The motor vehicle 10 comprises a reciprocating piston engine 11 as a driving component of the vehicle. The reciprocating piston engine 11 may be the engine described above and illustrated in FIG. 1 in one embodiment.

It will be appreciated that the motor vehicle shown in FIG. 2 is provided solely for illustrative purposes and the disclosed engine inclusive of a liner and reinforcing element may be applied to a variety of different motor vehicle types. As one example, the liner and reinforcing element may be applied to the engine of a larger vehicle such as a bus or truck.

The reciprocating piston engine 11 according to the disclosure is illustrated by way of example in FIGS. 3 through 5. Further, as shown in the figures, the reciprocating piston engine 11 comprises a housing 12 which is referred to herein as a cylinder block 12. In addition to the cylinder block 12, the reciprocating piston engine 11 may contain in particular, a cylinder head (such as the cylinder head of FIG. 1) which may be positioned in the customary manner along an upper side 26 of the cylinder block 12. At least one combustion chamber 13 is arranged in the cylinder block 12. FIG. 3 further illustrates one example embodiment and is shown with a single combustion chamber although embodiments are provided with more than one combustion chamber. For example, FIGS. 4 and 5 illustrate an exemplary embodiment comprising three combustion chambers 13.

Turning now to FIG. 3, a single combustion chamber 13 is provided in a top-down view to clarify the relative positioning of each component. The reciprocating piston engine 11 of this embodiment may be inclusive of a cylinder block 12, a combustion chamber 13, a liner 14 which may further include an inner side 21 and an outer side 22, a reinforcing element 17, and moldings 28.

The at least one combustion chamber 13 may be bordered by a liner 14 such that the liner fully surrounds the combustion chamber on a circumferential face. In engine embodiments comprising more than one cylinder, a liner 14 may be assigned to each of the combustion chambers 13 of the reciprocating piston engine 11. In one embodiment, the liner 14 may comprise a substantially cylindrical profile shape and the cylinder may further be substantially hollow in nature. An inner side 21 of the liner 14 may be directed toward the combustion chamber 13 wherein the inner side 21 is in direct face sharing contact with the external periphery of the combustion chamber 13 and an outer side 22 of the liner may be directed toward the cylinder block 12. The outer side 22 of the liner may be in direct face sharing contact with the reinforcing element 17. In this way, the inner side 21 of the liner may therefore, form a circumferential boundary of the combustion chamber 13.

The liner 14 may be arranged between the cylinder bock 12 and the combustion chamber 13 such that the liner is in direct face sharing contact with the outer periphery of the combustion chamber 13 and is also in direct face sharing contact with the reinforcing element at a face directed toward the cylinder block 12. Further, a cooling duct 20 for liquid cooling of the reciprocating piston engine 11 may be provided in the cylinder block on the outer side 22 of the liner 14 such that the cooling duct 20 may be sandwiched between an inner surface of the cylinder block and an external perimeter of the reinforcing element 17. The cooling duct 20 may be embodied in particular examples as a cooling jacket 20 which may extensively enclose and encapsulate the liner 14. The enclosure of the liner 14 by a cooling jacket 20 is illustrated in FIGS. 3 and 4.

The cylinder block 12 of the reciprocating piston engine 11 in one embodiment may include an open deck design in which the cooling duct 20 may be open on the upper side 26. In order to completely seal off the cooling duct 20, the cylinder head may have a correspondingly configured head seal.

With respect to FIG. 4, the figure illustrates a top-down view of an embodiment of the cylinder block 12 comprising three cylinders. Similarly to FIG. 3, the reciprocating engine illustrated is inclusive of a cylinder block 12, at least one combustion chamber 13, a liner 14 which is further inclusive of an inner side 21 and an outer side 22, a reinforcing element 17 and moldings 28. The combustion chambers 13 may be bordered by a liner 14 such that the liner 14 substantially surrounds the circumferential periphery of the combustion chambers.

In this view it is visible that in at least one embodiment, a liner 14 may be affixed to the interior of each individual combustion chamber 13 of the reciprocating piston engine 11 such that the combustion chamber is fully surrounded on an interior face by the liner 14. In this embodiment, the liner 14 is shown comprising a substantially cylindrical profile shape wherein the cylinder is hollow. An inner side 21 of the liner 14 may be directed toward the combustion chamber 13 wherein the inner side 21 is in direct face sharing contact with the external periphery of the combustion chamber 13 and an outer side of the liner 14 may be directed toward the cylinder block 12. The outer side 22 of the liner 14 may therefore be in direct face sharing contact with the reinforcing element 17 provided.

In one embodiment, the reinforcing element 17 may comprise a plurality of semicircular sections connecting with one another as illustrated in FIG. 4. The reinforcing element 17 may substantially surround the plurality of combustion chambers 13 such that the interfaces between the cylinder 13 and the cylinder block 12 is defined by the reinforcing element 17. In this way, it may be possible to reinforce the cylinder block 12 without limiting the motion of pistons within the provided cylinders 13. Further, as illustrated in the FIG. 4, the reinforcing element in some embodiments may not completely surround the entirety of the outer periphery of the cylinder 14 such that the amount of material required for the reinforcing element may be reduced and therefore the cost may also be reduced. As briefly noted above, in embodiments comprising more than one combustion chamber, although the reinforcing element 17 may not fully encapsulate or surround the combustion chamber on the entirety of its circumference, the liner 14 will be configured in these embodiments to fully surround the circumference of the combustion chamber 13.

The liner 14, in one embodiment may be arranged between the cylinder block 12 and the combustion chamber 13 such that the liner may be in direct face sharing contact with the outer periphery of the combustion chamber 13 and may be in direct face sharing contact with the reinforcing element 17 at least partially.

In one embodiment the reinforcing element may define a specific height which may be lesser or lower than the height of the liner. In this way, the reinforcing element may be arranged in sections. In a further embodiment, the reinforcing element may be arranged at an upper end of the liner relative to the engine's position in a motor vehicle. In this way, the reinforcing element may therefore act as the point at which there may exist the greatest risk of bore distortion.

As one example embodiment, the reinforcing element 17 may define a wall thickness which may be greater than the wall thickness of the liner. The reinforcing effect of the element 17 may therefore be increased since the larger the portion of the reinforcing element in an overall wall thickness resulting from the reinforcing element wall thickness may result in a greater overall structural rigidity of both components. In a further example, the liner may comprise a recess and the reinforcing element may be disposed within the recess of the liner. In this way, the reinforcing element may be configured to be even wider and the overall rigidity of the assembly may be increased. In addition, the position of the reinforcing element 17 during installation of the reciprocating piston engine 11 may be facilitated since the boundary of the recess may serve as a positioning aid in at least one example embodiment.

In anther embodiment, the reinforcing element may at least partially surround a plurality of liners such that a space saving configuration may be achieved. It will be appreciated that in one embodiment, the reinforcing element may comprise a closed basic shape, meaning that the reinforcing element may fully surround the combustion chamber. In still other embodiments however, the reinforcing element may comprise an open basic shape wherein the reinforcing element may not fully surround the circumferential face of the combustion chamber and liner. In this way, the reinforcing element may comprise sections.

In one example, the reinforcing element may further comprise a plurality of moldings on the outer face thereof. By way of the moldings, the surface of the outer side of the reinforcing element may be enhanced and therefore, a cooling effect may be achieved or increased.

FIG. 5 schematically illustrates a side view of a section through the cylinder block 12 and expands upon the view presented in FIG. 4. The liner 14, as is customary in the art, may be located in a region of the cylinder in which a piston (not shown) executes the reciprocating movements thereof. The liner 14 may have a linear height 15 and the linear height may extend from an upper end 18 down as far as a lower end 19 of the liner 14. The upper end 18 which defines a top surface of the liner may be directed in this case toward the upper side 26 of the cylinder block 12 which surrounds the components presented in FIG. 5 as depicted in FIG. 4.

A wall thickness of the liner 14 is referred to herein as the liner wall thickness 16 and defines the width of the liner. The liner 14 may be manufactured from a first material, in particular, from gray cast iron or from aluminum wherein aluminum may also include aluminum alloys. It will be appreciated that the material from which the liner is manufactured may be selected to have a lower modulus of elasticity than the material from which the cylinder block 12 is constructed. In one example, the higher/lower modulus of elasticities of the various components may be the modulus throughout said component, in that the modulus of elasticity is constant (e.g., with 5%) across the entire material of the component.

In one embodiment, the reciprocating piston engine 11 may comprise a reinforcing element 17 that defines an interface between the combustion chamber 13 and the cylinder block 12. The reinforcing element 17 may be configured to support the liner 14 in a manner such that a radial expansion of the liner 14 may be made difficult. In this way, the resistance to deformation of the liner 14 may be increased by means of the reinforcing element 17. The liner 14 may have a greater rigidity together with the reinforcing element 17 than without the reinforcing element 17. The reinforcing element 17 may be manufactured from a second material that is different from the first material. For example, in one embodiment, the reinforcing element 17 may be constructed of steel. According to the disclosure, the second material should have a higher coefficient of elasticity compared to the first material from which the liner 14 is manufactured.

Further, the reinforcing element 17 may be arranged in at least one embodiment between the liner 14 and the engine block 12. The reinforcing element 17 may be pressed or shrunken thereon or cast therein in some example embodiments. The reinforcing element 17 may be arranged in a manner such that it bears against the outer side 22 of the liner 14 and surrounds the liner 14 at in at least one region. The reinforcing element 17 may further be arranged at the upper end 18 of the liner 14 and may rest particularly flush with the liner 14.

The reinforcing element 17 may have a reinforcing element height 23 which may be lower than the liner height 15. It may therefore be possible for a plurality of reinforcing elements 17 to be arranged along the liner height 15. The reinforcing element 17 may furthermore comprise a reinforcing element wall thickness 24 which may be greater in width than the liner wall thickness 16.

The upper end 18 of the liner 14 may have a recess 25 which may allow for receiving the reinforcing element 17. The liner wall thickness 16 may be reduced at the location of the recess 25 in at least one example embodiment.

The reinforcing element 17 may at least partially project along with the outer side 27 thereof into the cooling duct 20 in one example. In another example embodiment, moldings 28 may be provided for increasing the surface of the outer side 27 of the reinforcing element and may be arranged along an outer side 27 of the reinforcing element 17 as illustrated in FIG. 2. Further, the moldings 28 may be provided in at least one embodiment as cooling fins for example.

The reinforcing element 17 may, in particular, be a basic cross section of solid design as shown in FIG. 5. The configuration of the reinforcing element 17 in the plane of the surface 26 may be matched to the number of cylinders or combustion chambers 13 and liners 14 within the reciprocating piston engine 11.

For illustrative purposes, FIG. 3 shows an embodiment having a single combustion chamber 13 and accordingly with a single liner 14. The reinforcing element 17 in this case is shown in the form of a closed circular ring. It is also possible for the reinforcing element 17 to be designed or configured as a non-circular and/or open ring. If the reciprocating piston engine 11 comprises a plurality of liners 14 as in one example embodiment, the reinforcing element 17 may engage around the plurality of liners 14. An exemplary embodiment with three combustion chambers 13 and three liners 14 is illustrated in FIG. 4. In the same plane of the upper side 26, the reinforcing element 17 in this embodiment may comprise a closed configuration which may be assembled from four circular ring segments and may surround the three circles defined by the ring segments. It may also be possible for the reciprocating piston engine 11 to comprise a plurality of reinforcing elements 17 each of which may reinforce at least one liner 14. A plurality of embodiment possibilities depending on the number of cylinders of the engine, the cylinder arrangement, and the cylinder spacing may be provided such that a person of ordinary skill in the art may practice the present subject matter in accordance with the disclosure.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

In this way, by providing a liner within the combustion chamber(s) of an internal combustion reciprocating piston engine, the structural rigidity and resistance to deformation of the cylinder block may be improved.

As one example of a technical effect of providing a reinforcing element within the cylinder block that at least partially surrounds a plurality of liners such as in an embodiment comprising multiple cylinders is that a space-saving configuration of the reinforced combustion chambers may be possible. Additionally, fewer individual parts may have to be manufactured or milled in the manufacturing process.

An additional technical effect of a closed basic shape of the reinforcing element (such as the embodiment provided in FIG. 3 is that a greater structural rigidity of the reinforcing element may be obtained when compared to a partially open basic shape (such as the embodiment shown in FIG. 4).

As one embodiment, a reciprocating piston engine comprising a cylinder block, at least one combustion chamber arranged in the cylinder block, and a liner which borders the combustion chamber and is composed of a first material, wherein the reciprocating piston engine comprises a reinforcing element composed of a second material for the radial reinforcement of the liner, said reinforcing element being arranged between the cylinder block and the liner and at least partially surrounding the liner, with the second material having a higher modulus of elasticity than the first material is provided. In a first example of the reciprocating engine, the liner is composed of a gray cast iron or aluminum and the reinforcing element is composed of steel. A second example of the reciprocating piston engine may optionally include the first example and may further include wherein the reinforcing element has a reinforcing element height which is lower than a liner height of the liner. A third example of the reciprocating piston engine may optionally include any of the first and second examples and may further include the reinforcing element arranged at an upper end of the liner. A fourth example of the reciprocating engine may include one or more of the first through third examples and further includes the reinforcing element having a reinforcing element wall thickness which is greater than a liner wall thickness of the liner. A fifth example of the reciprocating piston engine may include one or more of the first through fourth examples and may further include the liner having a recess and the reinforcing element being arranged in the recess. A sixth example of the reciprocating piston engine may include one or more of the first through fifth examples and may further include the reinforcing element at least partially surrounding a plurality of liners. A seventh example of the reciprocating piston engine may include any of the first through sixth examples and further includes the reinforcing element having a closed basic shape. An eighth example of the reciprocating piston engine may optionally include one or more of the first through seventh examples and further includes the reinforcing element having moldings on the outer side thereof. A ninth example of the reciprocating piston engine may optionally include one or more of the first through eighth examples and further includes the reciprocating piston engine embodied in an open deck design.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A reciprocating piston engine comprising:

a cylinder block, and a plurality of combustion chambers arranged in the cylinder block, wherein each combustion chamber has a liner composed of gray cast iron which borders the combustion chamber and is composed of a first material, wherein the reciprocating piston engine comprises a reinforcing element composed of a second material for radial reinforcement of the liners, wherein said reinforcing element is arranged between the cylinder block and the liners, wherein said reinforcing element comprises a plurality of semicircular sections connecting with one another, each section partially surrounding, but not fully surrounding, a circumference of a corresponding one of the plurality of combustion chambers, and wherein the second material has a higher modulus of elasticity than the first material.

2. The reciprocating piston engine as claimed in claim 1, wherein the reinforcing element is composed of steel.

3. The reciprocating piston engine as claimed in claim 1, wherein the reinforcing element has a reinforcing element height which is lower than a liner height of the liners.

4. The reciprocating piston engine as claimed in claim 1, wherein the reinforcing element is arranged at an upper end of the liners.

5. The reciprocating piston engine as claimed in claim 1, wherein the reinforcing element has a reinforcing element wall thickness which is greater than a liner wall thickness of the liners.

6. The reciprocating piston engine as claimed in claim 1, wherein each liner has a recess and the reinforcing element is arranged in the recesses.

7. The reciprocating piston engine as claimed in claim 1, wherein the reinforcing element has moldings on an outer side thereof.

8. The reciprocating piston engine as claimed in claim 7, wherein the moldings comprise a plurality of cooling fins arranged along the outer side of the reinforcing element.

9. A reciprocating piston engine comprising:

a cylinder block, cylinders arranged in the cylinder block, a liner bordering each cylinder, the liners composed of a first material comprising gray cast iron; and a reinforcing element composed of a second material for radial reinforcement of the liners, the reinforcing element arranged between the cylinder block and the liners, with the second material having a higher modulus of elasticity than the first material, wherein the reinforcing element comprises a plurality of semicircular sections connecting with one another, each section partially surrounding, but not fully surrounding, a circumference of a corresponding one of the cylinders, and wherein the reciprocating piston engine comprises an open deck design.

10. The reciprocating piston engine as claimed in claim 9, wherein the reinforcing element is composed of steel, and where no other material is between the cylinder block and the liners, and wherein the cylinder block and the liners are each in face-sharing contact with the reinforcing element.

11. The reciprocating piston engine as claimed in claim 10, wherein the reinforcing element has a reinforcing element height which is lower than a liner height of the liners.

12. The reciprocating piston engine as claimed in claim 9, wherein the reinforcing element is arranged only at an upper end of the liners.

13. The reciprocating piston engine as claimed in claim 9, wherein the reinforcing element has a reinforcing element wall thickness which is greater than a liner wall thickness of the liners for a majority of the liners.

14. The reciprocating piston engine as claimed in claim 9, wherein each liner has a recess and the reinforcing element is arranged in the recesses.

15. The reciprocating piston engine as claimed in claim 9, wherein the reinforcing element has moldings on an outer side thereof.

16. The reciprocating piston engine as claimed in claim 15, wherein the moldings comprise a plurality of cooling fins arranged along the outer side of the reinforcing element.

* * * * *